US005263908A

United States Patent [19]

Chen

[11] Patent Number: 5,263,908

[45] Date of Patent: Nov. 23, 1993

[54] MULTI-FUNCTIONAL PHYSICAL EXERCISE APPARATUS

[76] Inventor: Ping Chen, No. 29, Nan-Mei St., Nan-Tun Dist., Taichung City, Taiwan

[21] Appl. No.: 972,172

[22] Filed: Nov. 4, 1992

[51] Int. Cl.[5] ..... A63B 5/00

[52] U.S. Cl. ..... 482/44; 482/46; 482/127; 482/128

[58] Field of Search ..... 482/44, 45, 46, 49, 482/121, 127, 128; 220/761, 770

[56] References Cited

U.S. PATENT DOCUMENTS

| | | | |
|---|---|---|---|
| 2,147,471 | 2/1939 | Tyrrell et al. | 220/761 |
| 3,330,558 | 7/1967 | Simons, Jr. | 482/46 |
| 3,611,807 | 10/1971 | Brandell | 482/49 |
| 3,830,493 | 8/1974 | Miller | 482/46 |
| 4,474,303 | 10/1984 | Maccise | 220/761 |
| 4,591,151 | 5/1986 | Hensky | 482/46 |
| 4,643,417 | 2/1987 | Nieman | 482/46 |

FOREIGN PATENT DOCUMENTS

| | | | |
|---|---|---|---|
| 1012574 | 6/1977 | Canada | 482/128 |
| 3432899 | 3/1986 | Fed. Rep. of Germany | 482/44 |

*Primary Examiner*—Richard J. Apley
*Assistant Examiner*—Jeanne M. Mollo
*Attorney, Agent, or Firm*—Ladas & Parry

[57] ABSTRACT

A multi-functional physical exercise apparatus includes a small hollow cylinder, a large hollow cylinder, a confining device and a coiled spring. The large hollow cylinder is sleeved movably on a normal position on the small hollow cylinder. The confining device confines the large hollow cylinder on the small hollow cylinder. The coiled spring is secured to one of the small and large hollow cylinders at one end thereof and is confined at a predetermined position in the other one of the small and large hollow cylinders at the other end of the coiled spring. Accordingly, in a case where the large hollow cylinder is rotated relative to the small hollow cylinder or is moved toward the outer end of the small hollow cylinder, releasing one of the small and large hollow cylinders causes the large hollow cylinder to return to the normal position on the small hollow cylinder.

2 Claims, 9 Drawing Sheets

MULTI-FUNCTIONAL PHYSICAL EXERCISE APPARATUS

BACKGROUND OF THE INVENTION

1. Field of the Invention

This invention relates to a physical exercise apparatus, more particularly to a multi-functional physical exercise apparatus.

2. Description of the Related Art

Some conventional physical exercise apparatus, such as dumbbells, chest pulls, wrist trainers, etc., are portable and permit the user to exercise anywhere at his/her convenience.

The main drawback of conventional physical exercise apparatus is that they allow exercising of only one body part. Different types of physical exercise apparatus must be bought so as to exercise different body parts.

SUMMARY OF THE INVENTION

Therefore, the main object of this invention is to provide a multi-functional physical exercise apparatus which can be used to exercise more than one body part.

According to this invention, a multi-functional physical exercise apparatus includes a small hollow cylinder, a large hollow cylinder, a confining device and a coiled spring. The large hollow cylinder is sleeved movably on a normal position on the small hollow cylinder. The confining device confines the large hollow cylinder on the small hollow cylinder. The coiled spring is secured to one of the small and large hollow cylinders at one end thereof and is confined at a predetermined position in the other of the small and large hollow cylinders at the other end of the coiled spring. Accordingly, in a case where the large hollow cylinder is rotated relative to the small hollow cylinder or is moved toward the outer end of the small hollow cylinder, releasing one of the small and large hollow cylinders causes the large hollow cylinder to return to the normal position on the small hollow cylinder.

BRIEF DESCRIPTION OF THE DRAWINGS

Other features and advantages of this invention will become apparent in the following detailed description of the preferred embodiment, with reference to the accompanying drawings, in which.

DETAILED DESCRIPTION OF THE PREFERRED EMBODIMENT

Figures 1, 10:
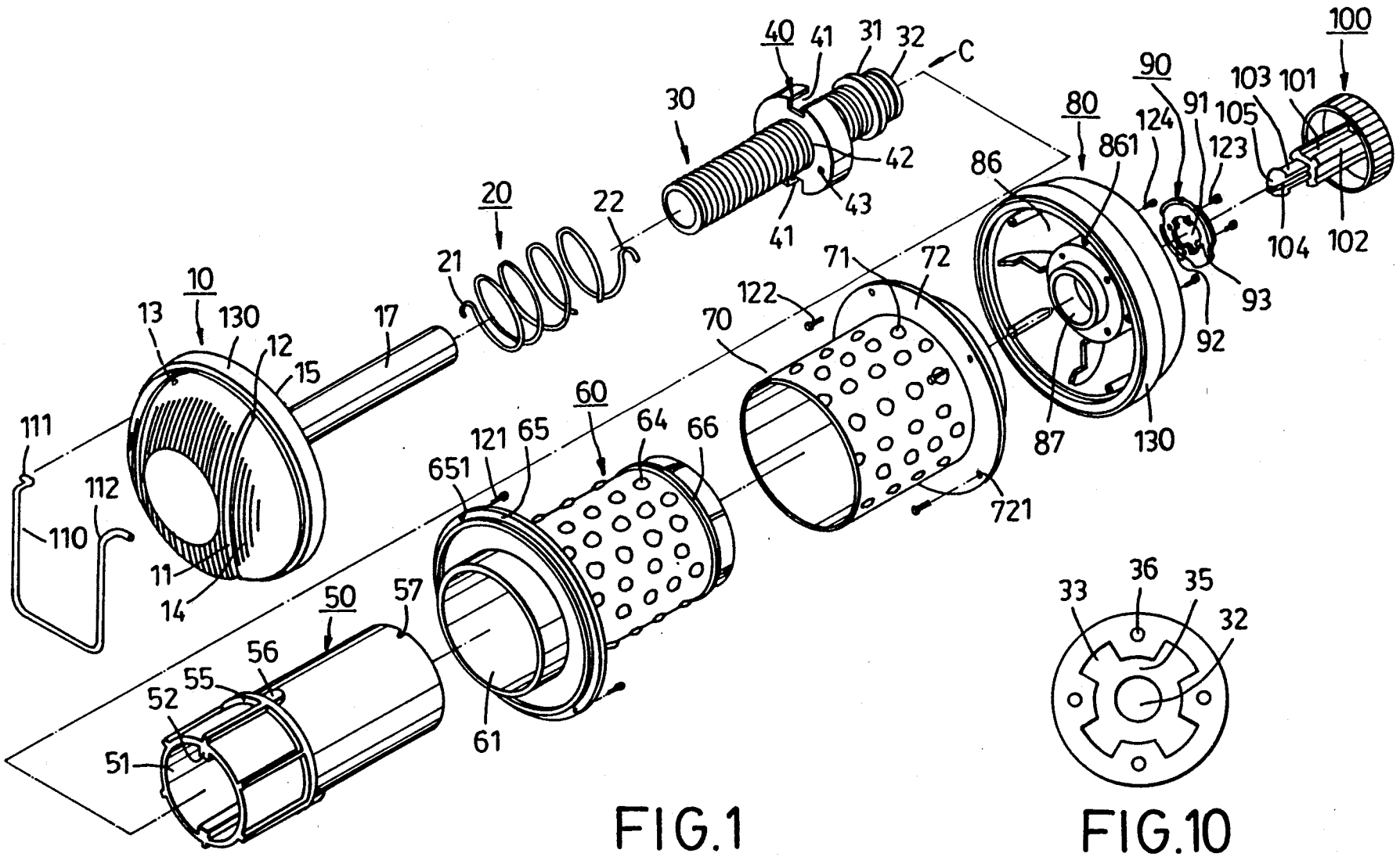
FIG. 1 is an exploded view of a multi-functional physical exercise apparatus according to this invention.
FIG. 10 is an enlarged end view showing the adjustment rod of the multi-functional physical exercise apparatus according to this invention.
Figure 2:
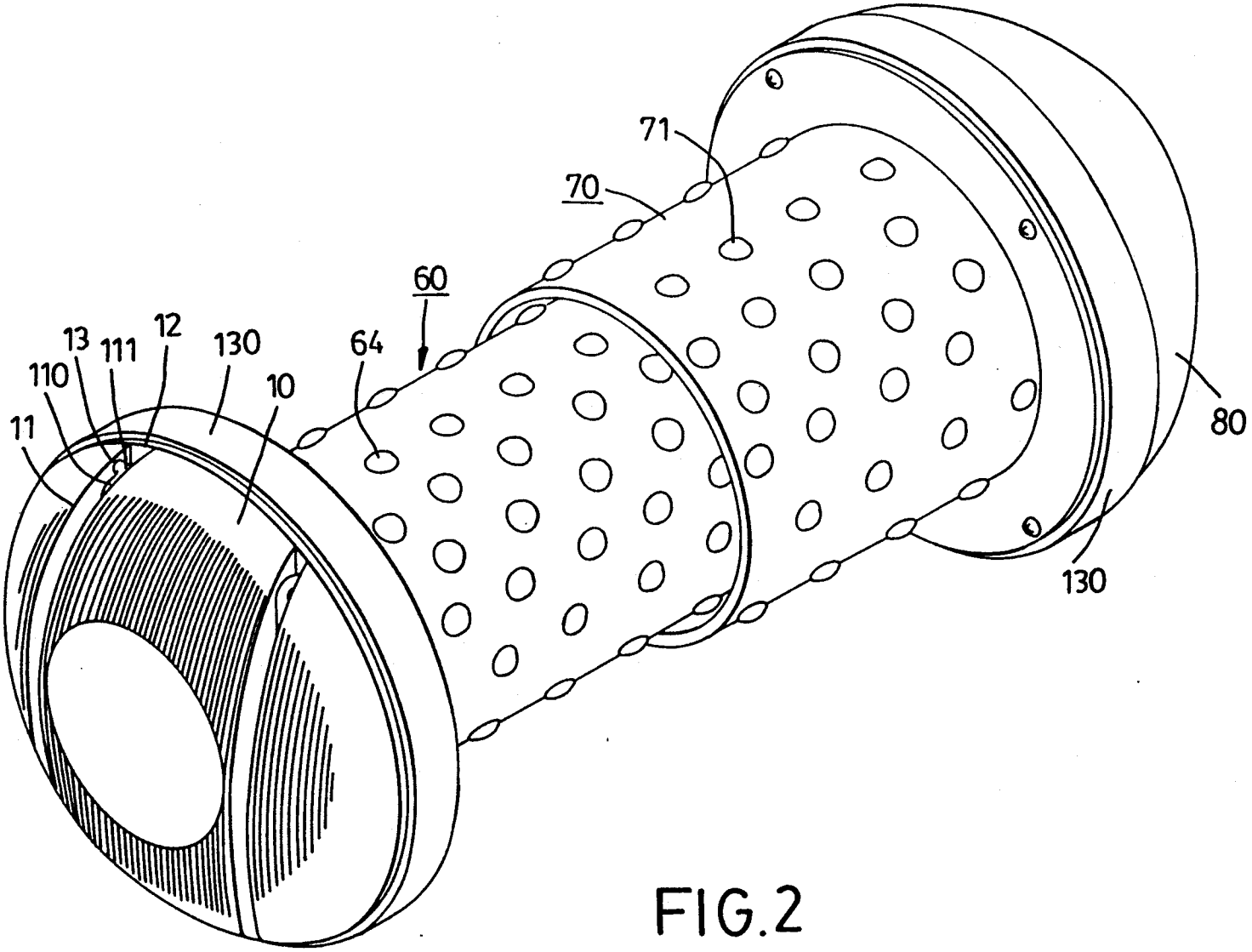
FIG. 2 is a perspective view showing the multi-functional physical exercise apparatus of this invention.
Figure 3:
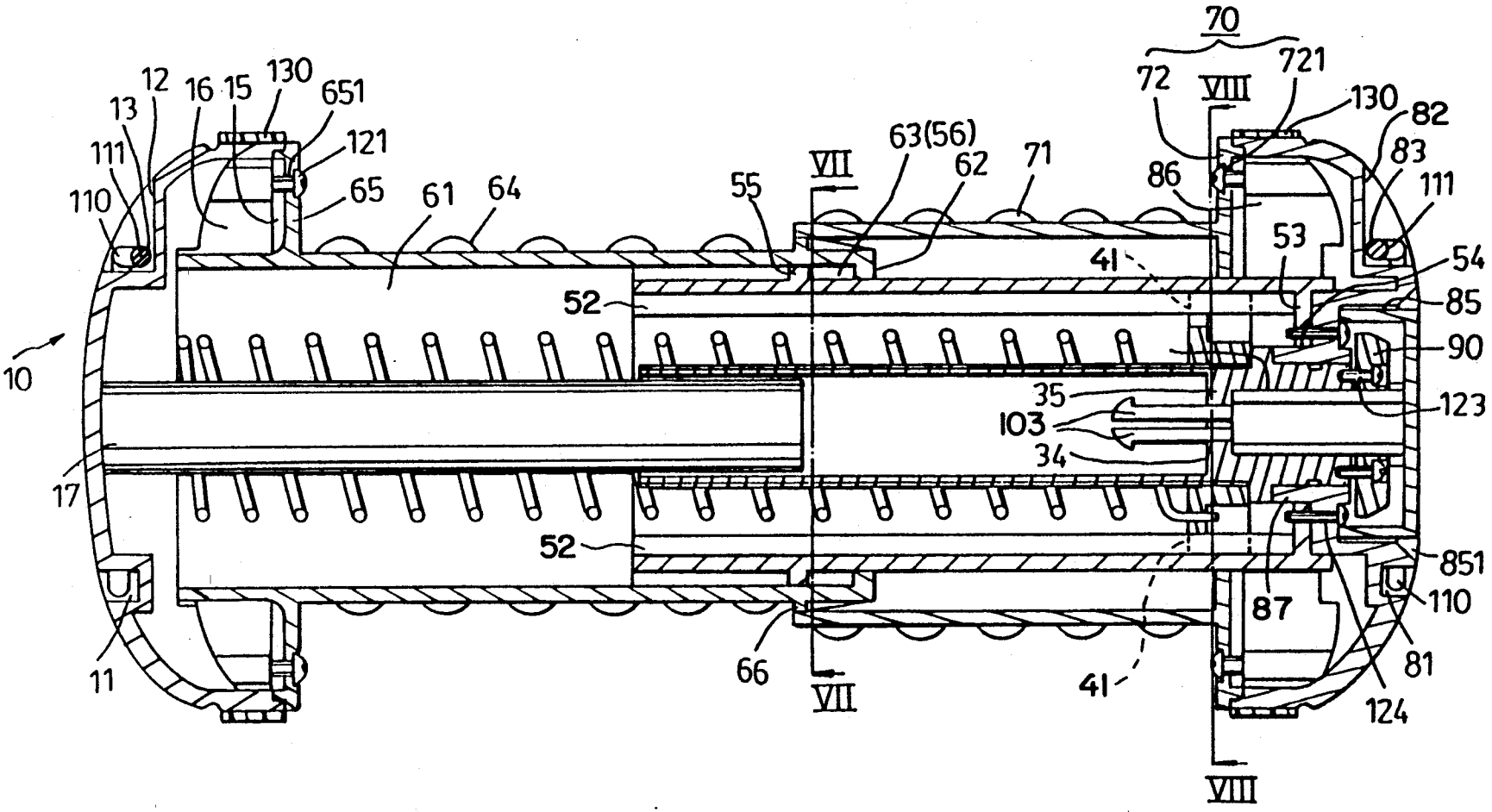
FIG. 3 is a sectional view showing the multi-functional physical exercise apparatus of this invention.
Figure 4:
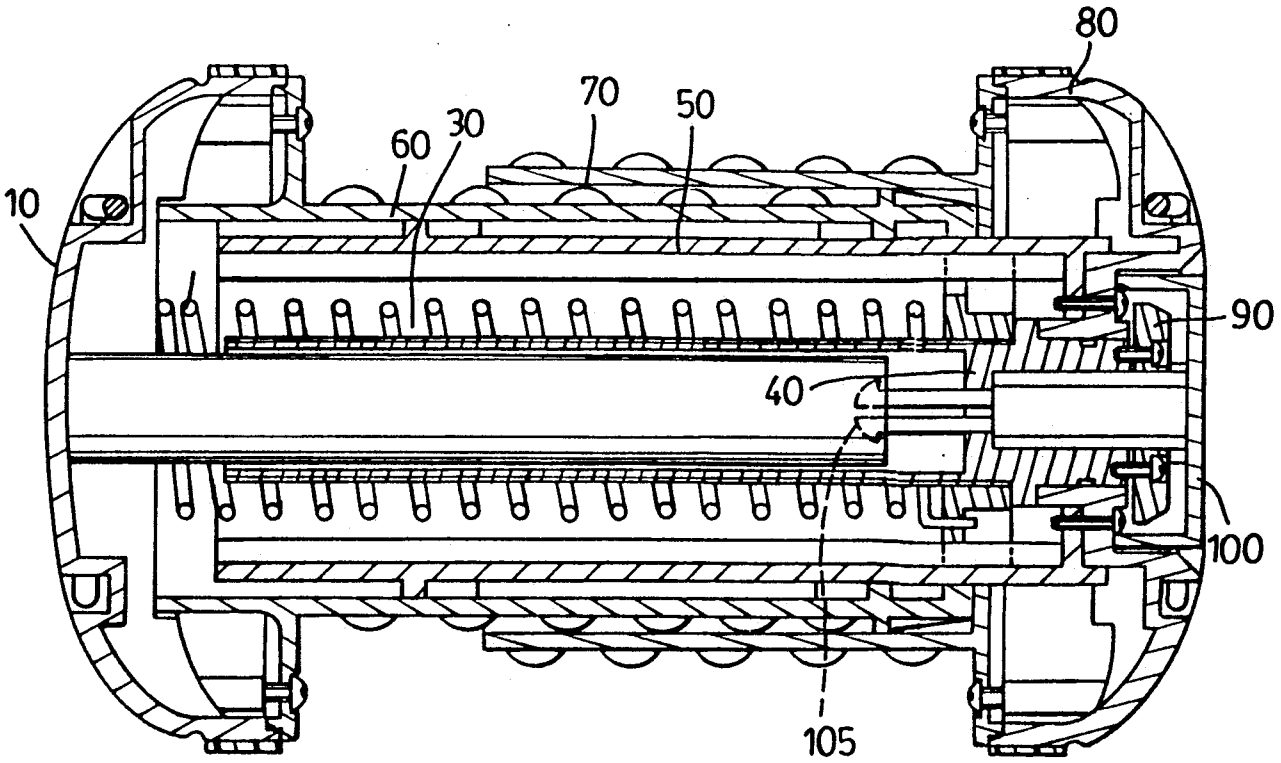
FIG. 4 is a sectional view showing the multi-functional physical exercise apparatus of this invention wherein the coiled spring is compressed.
Figure 5:
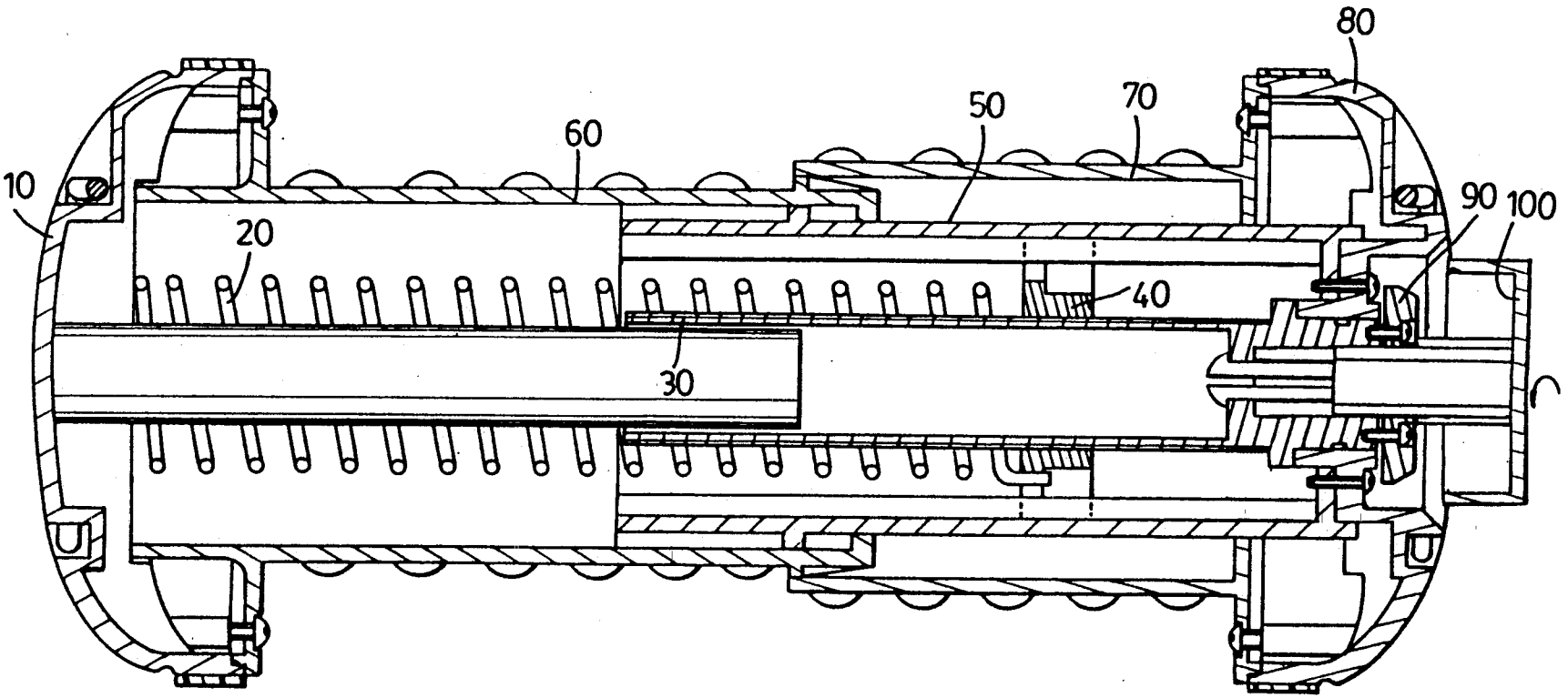
FIG. 5 is a sectional view showing the multi-functional physical exercise apparatus of this invention wherein the rotary knob is operated.

Referring to FIGS. 1, 2 and 3, a multi-functional physical exercise apparatus of this invention includes a cover (10), a coiled spring (20), an adjustment rod (30), a pressing element (40), a small hollow cylinder (50), a large hollow cylinder (60), an outer hollow cylinder (70), a retaining cap (80), a retaining ring (90) and a rotary knob (100).

Figure 6:
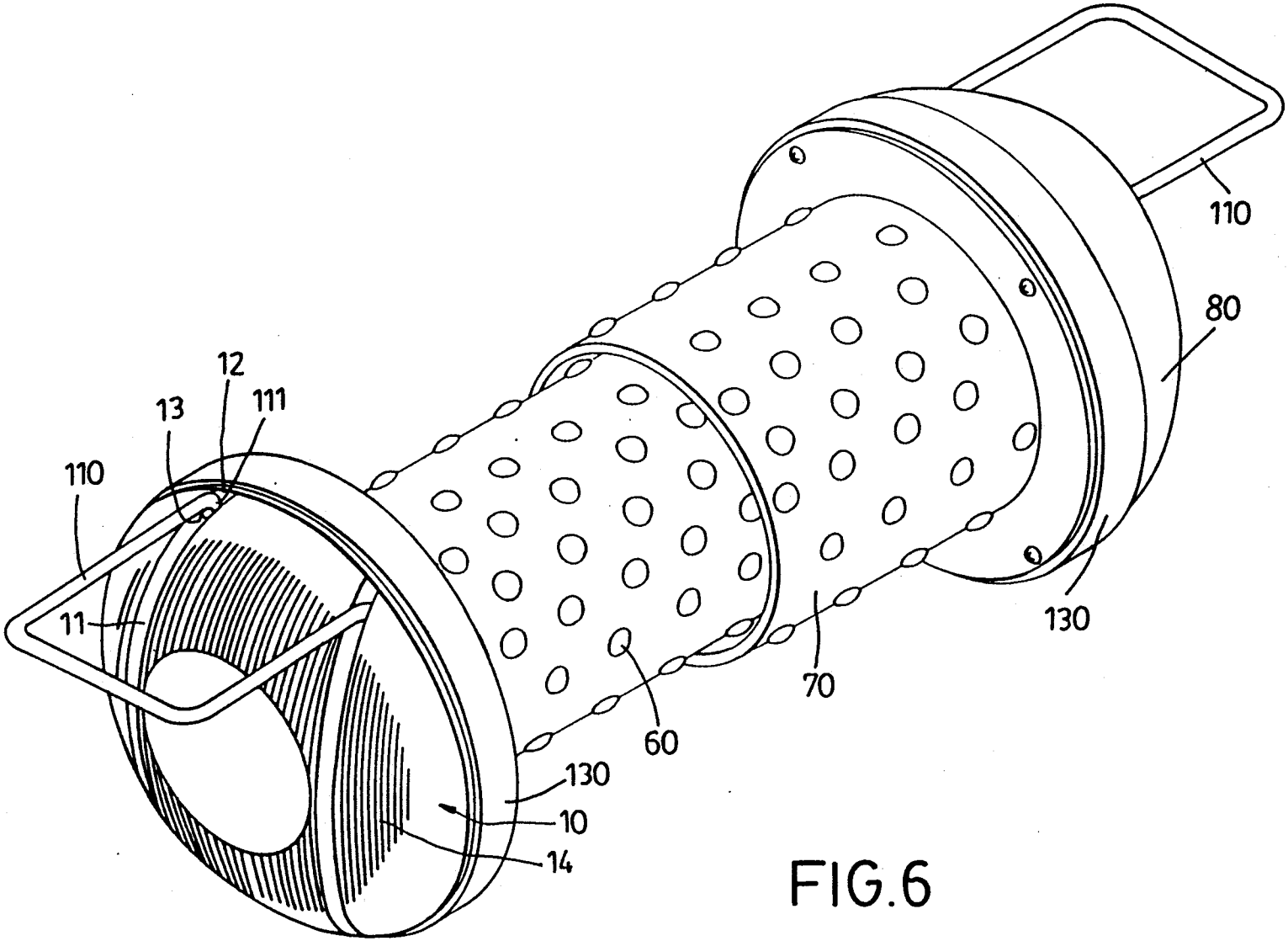
FIG. 6 is a perspective view showing the multi-functional physical apparatus wherein the pulling strips are in use.
Figure 9:
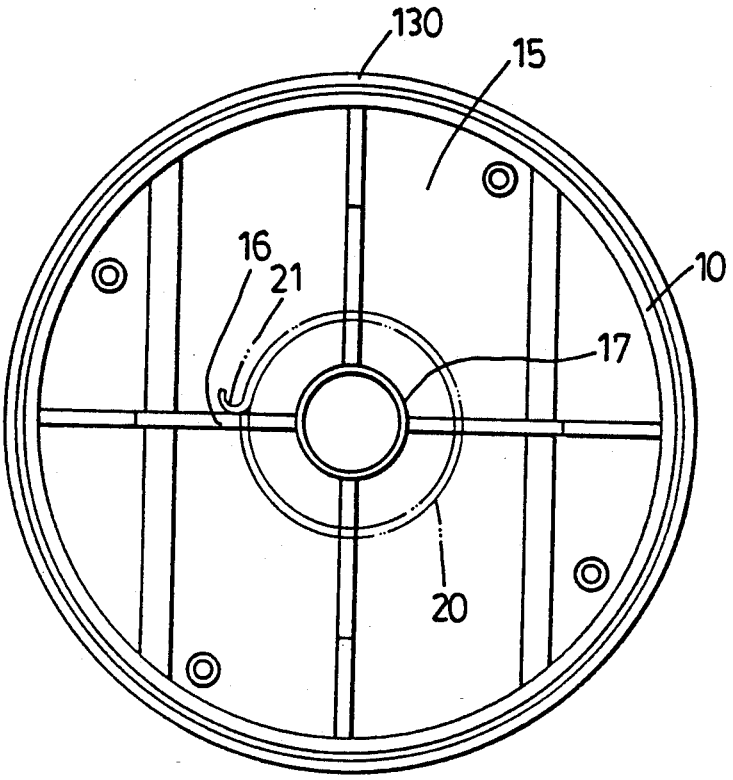
FIG. 9 is a side view showing the cover of the multi-functional physical exercise apparatus according to this invention.

The cover (10) includes two parallel grooves (11) formed in the outward surface thereof, two pivot holes (13) which are respectively formed in the side walls of the grooves (11), two planar positioning surfaces (12) forming the bottom walls of the grooves (11), and a U-shaped positioning strip (110) having a U-shaped body with two parallel legs and two L-shaped horizontal end portions (111). Each of the end portions (111) has a pivot end engaged within one of the pivotal holes (13). Referring to FIG. 6, when the body of the positioning strip (110) is removed from the groove (11) and is located at a horizontal position, the positioning section (112) of the positioning strip (110) lies against the positioning surface (12) so as to locate the positioning strip (110) at a horizontal position. A plurality of slippage resisting notches (14) are formed in the outward surface of the cover (10) so as to prevent sliding movement of the hand thereon. As best shown in FIG. 9, the cover (10) further includes a depression (15) formed in the inward surface thereof, four confining ribs (16) dividing the depression (15) into four confining spaces, a central rod (17) projecting axially from the inward surface of the cover (10), and a rubber ring (130) adhered to the outer peripheral surface of the cover (10) for protective purposes. The left end (21) of the spring (20) is confined in one of the confining spaces which are defined by the confining ribs (16).

The left portion of the adjustment rod (30) is hollow so that the central rod (17) is inserted therein. The spring (20) is sleeved on the central rod (17) and the adjustment rod (30) between the cover (10) and the pressing element (40). The adjustment rod (30) is externally threaded and the pressing element (40) is internally threaded so as to engage the adjustment rod (30) threadably within the pressing element (40).

The adjustment rod (30) includes an outward flange (31) projecting from the right end portion thereof, and an inward flange (35) projecting from the right end of the adjustment rod (30) so as to define a central hole (32) therein. As shown in FIG. 3, the outer end portion of the inward flange (35) has a recess in which four axially extending grooves (33) (see FIG. 10) are formed in the inner surface of the rod (30) so as to form a splined surface. A shoulder (34) is defined by the inward flange (35). Four threaded holes (36) are formed in the right end surface of the rod (30).

The pressing element (40) is generally shaped in the form of a circular disk and has two opposed guiding slots (41) formed in the outer peripheral surface thereof, a threaded bore (42) formed in the center of the pressing element (40), and a fastening hole (43) formed in the left end surface of the pressing element (40). The right end of the spring (20) is secured in the fastening hole (43) of the pressing element (40).

Figure 7A:
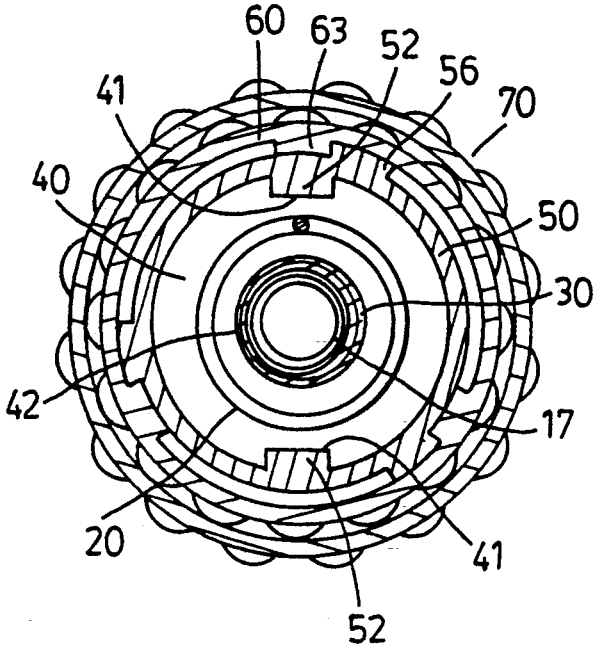
FIGS. 7A and 7B are sectional views taken along Line VII—VII in FIG. 3.
Figure 7B:
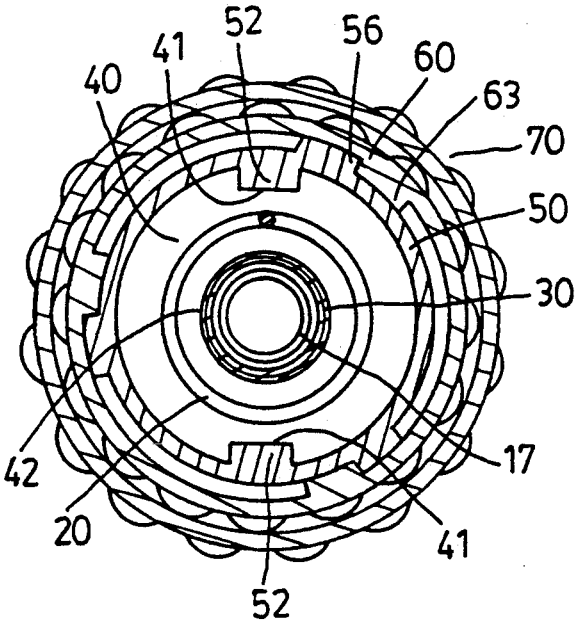
Figure 8:
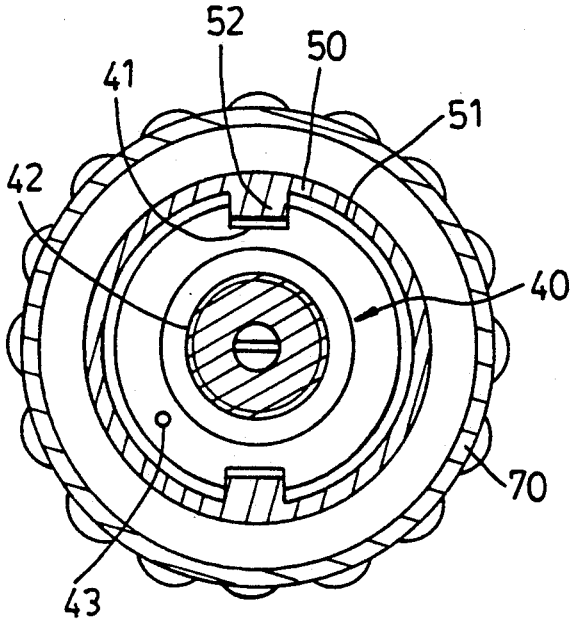
FIG. 8 is sectional view taken along Line VIII—VIII in FIG. 3.

The small hollow cylinder (50) surrounds the adjustment rod (30) and has an inner surface (51) from which two opposed guiding ribs (52) project to engage the guiding slots (41) of the pressing element (4) so as to prevent rotation of the pressing element (40) relative to the small hollow cylinder (50) while permitting axial movement of the pressing element (40) relative to the small hollow cylinder (50). As shown in FIG. 3, an inward flange (53) projects from the right end portion of the small hollow cylinder (50) and defines a central hole (54) therein. An outward flange (55) (see FIG. 1) is provided on the outward surface of the small hollow cylinder (50). As best shown in FIGS. 7A and 7B, three, angularly equidistant first positioning ribs (56) project axially from the right side of the outward flange (55) and define three first positioning spaces, each of which is positioned between a pair of first positioning ribs (56). A notch (57) is formed in the right end surface of the small hollow cylinder (50). The small hollow cylinder (50) is inserted into the large hollow cylinder (60).

The large hollow cylinder (60) surrounds the central rod (17) and includes a central bore (61), an inward flange (62) projecting from the right end of the large hollow cylinder (60), and three angularly equidistant second positioning ribs (63) which project axially from the left side of the inward flange (62) into the first positioning spaces so as to define three second positioning spaces, each of which is positioned between a pair of second positioning ribs (63). Similarly, the first positioning ribs (56) respectively extend into the second positioning spaces. Because each of the first positioning ribs (56) can move between a pair of second positioning ribs (63), the large hollow cylinder (60) can be rotated a maximum angle of 120 degrees relative to the small hollow cylinder (50). A plurality of slippage resisting projections (64) are provided on the outward surface of the large hollow cylinder (60). A large outward flange (65) and a small outward flange (66) are respectively provided on the left and right end portions of the large hollow cylinder (60). The large outward flange (65) has four holes (651) formed therethrough so that bolts (121) can extend through the holes (651) to engage the threaded holes (see FIG. 9) of the cover (10).

The outer hollow cylinder (70) is sleeved on the right portion of the large hollow cylinder (60) and includes a plurality of slippage resisting projections (71) provided on the outer surface thereof, and an outward flange (72) projecting from the right end portion of the outer hollow cylinder (70). Several holes (721) are formed through the outward flange (72) so that bolts (122) extend through the holes (721) to engage the threaded holes of the retaining cap (80).

The outward surface of the retaining cap (80) has two parallel grooves (81), two planar positioning surfaces (82), two pivot holes (83) and a plurality of slippage resisting notches (not shown) which are similar to the grooves (11), the positioning surfaces (12), the pivot holes (13) and the slippage resisting notches (14) of the cover (10) in construction. A socket (85) is provided at the outer end of the retaining cap (80) and has two inclined guide portions (851). The inner end portion of the retaining cap (80) has a depression (86), an engaging protrusion (861) engaged within the notch (57) of the small hollow cylinder (50), and a circular tubular projection (87). As best shown in FIG. 3, the circular tubular projection (87) extends through the central hole (54) of the small hollow cylinder (50). Bolts (124) extend through the retaining cap (80) to engage the threaded holes of the inward flange (53) of the small hollow cylinder (50). The right end of the adjustment rod (30) is journalled within the circular tubular projection (87) of the retaining cap (80). A rubber ring (130) is adhered to the outer peripheral surface of the retaining cap (80).

The retaining ring (90) has a central hole (91), and four projections (92) protruding from the ring (90) so that the shape of the central hole (91) of the retaining ring (90) conforms to the central hole of the right end surface of the adjustment rod (30). Bolts (123) extend through the holes (93) of the retaining ring (90) to engage the threaded holes (36) (see FIG. 10) of the adjustment rod (30) in such a manner that the retaining ring (90) is spaced apart from the retaining cap (80), thereby enabling rotation of the retaining ring (90) relative to the retaining cap (80).

The rotary knob (100) has an externally splined stem (101) projecting axially inwardly therefrom, which stem (101) has four axially extending ribs (102) that engage the grooves (33) of the adjustment rod (30), thereby allowing relative movement between the adjustment rod (30) and the rotary knob (100) while preventing relative rotation between the adjustment rod (30) and the rotary knob (100). The rotary knob (100) further has two spaced-apart parallel holding strips (103) which define a space (104) therebetween. The holding strips (103) extend into the adjustment rod (30) through the inward flange (35) of the adjustment rod (30) and have enlarged ends (105) which are sized so as to be confined in the adjustment rod (30). When one desires to use the rotary knob (100), two fingers can extend into the inclined guide portions (851) of the socket (85) of the retaining cap (80) and hold the rotary knob (100) therebetween.

In assembly, the spring (20) is sleeved on the left portion of the adjustment rod (30). The central rod (17) is inserted into the left portion of the adjustment rod (30) so as to position the spring (20) between the cover (10) and the pressing element (40). The U-shaped positioning strip (110) is pivoted to the cover (10). The small hollow cylinder (50) is sleeved on the assembly of the cover (10), the spring (20) and the adjustment rod (30) in such a manner that the guiding ribs (52) engage the guiding slots (41). The large hollow cylinder (60) is sleeved on the small hollow cylinder (50) and is screwed to the cover (10). The outer hollow cylinder (70) is sleeved on the large hollow cylinder (60). The retaining cap (80) is screwed to the small hollow cylinder (50) and the large hollow cylinder (70) in such a manner that the right end of the adjustment rod (30) is journalled within the circular tubular projection (87) of the retaining cap (80). The retaining ring (90) is screwed to the adjustment rod (30) The holding strips (103) of the rotary knob (100) are inserted into the adjustment rod (30) through the retaining ring (90). The U-shaped positioning strip (110) is pivoted to the retaining cap (80). Finally, the rubber rings (130) are adhered to the cover (10) and the retaining cap (80). The inward flange (62) of the large hollow cylinder (60), the outward flange (55) of the small hollow cylinder (50), and the retaining cap (80) constitute a confining device. Because the inward flange (62) is confined between the outward flange (55) and the retaining cap (80), the large hollow cylinder (60) cannot separate from the small hollow cylinder (50).

When the preferred embodiment is used to exercise the chest muscles, the cover (10) and the retaining cap (80) are pushed toward each other by two hands so as to compress the spring (20). The compressed spring (20) has the tendency to move the cover (10) and the retaining cap (80) away from each other. In this case, the spring (20) functions as a compression spring. To exercise the arm muscles, the large hollow cylinder (60) and the outer hollow cylinder (70) are held by two hands respectively and are rotated relative to each other so as to change relative angular position of the two ends of the spring (20). In this case, the spring (20) acts as a torsion spring. Referring to FIG. 6, to exercise the leg muscles, the respective bodies of the U-shaped positioning strips (110) are pulled out and are located at horizontal positions. One of the knees of the user is positioned between the body of the U-shaped positioning strip (110) and the cover (10). The other one of the knees of the user is positioned between the body of the U-shaped positioning strip (110) and the retaining cap (80). The knees are then moved toward each other to compress the apparatus.

When it is desired to adjust the compression force of the spring (20), the rotary knob (100) is pulled so as to remove the same from the socket (85) of the retaining cap (80). Then, the rotary knob (100) is rotated relative to retaining cap (80) so as to rotate the adjustment rod (30) in the small hollow cylinder (50) and the outer hollow cylinder (70), thereby moving the pressing element (40) toward or away from the cover (10).

When it is desired to adjust the torsion of the spring (20), the cover (10) and the retaining cap (80) are pushed toward each other so as to remove the first positioning ribs (56) of the small hollow cylinder (50) from the second positioning spaces of the large hollow cylinder (60) and so as to remove the second positioning ribs (63) of the large hollow cylinder (60) from the first positioning spaces of the small hollow cylinder (50) At this time, the relative position of the first positioning ribs (56) and the second positioning ribs (63) can be moved from the position shown in FIG. 1 to the position shown in FIG. 2.

With this invention thus explained, it is apparent that numerous modifications and variations can be made without departing from the scope and spirit of this invention. It is therefore intended that this invention be limited only as indicated in the appended claims.

I claim:

1. A multi-functional physical exercise apparatus, comprising:

a small hollow cylinder;

a large hollow cylinder sleeved movably on a normal position on said small hollow cylinder;

a confining device confining said large hollow cylinder on said small hollow cylinder, wherein said confining device includes an inward flange projecting from an inner surface of said large hollow cylinder, said small hollow cylinder extending through said inward flange of said large hollow cylinder, an outward flange projecting from an outer surface of said small hollow cylinder and sized so that said outward flange can be put into said large hollow cylinder but cannot pass through said inward flange of said large hollow cylinder, and a retaining cap connected removably to an end of said small hollow cylinder so as to confine said inward flange of said large hollow cylinder between said outward flange of said small hollow cylinder and said retaining cap;

a coiled spring secured to one of said small and large hollow cylinders at one end thereof and confined at a predetermined position in the other one of said small and large hollow cylinders at the other end of said coiled spring; and a torsion adjustment device provided to adjust torsion of said spring, wherein said torsion adjustment device includes a plurality of axially extending first positioning ribs projecting from said outward flange of said small hollow cylinder to define a plurality of first positioning spaces, each of which is located between a pair of said first positioning ribs, and a plurality of axially extending second positioning ribs projecting from said inward flange of said large hollow cylinder toward said outward flange of said small hollow cylinder to define a plurality of second positioning spaces, each of which is located between a pair of said second positioning ribs, said first positioning ribs engaging said second positioning ribs when said apparatus is in use, whereby, when said large hollow cylinder is pushed toward an outer end of said small hollow cylinder so as to disengage said first positioning ribs from said second positioning spaces and so as to disengage said second positioning ribs from said first positioning spaces, one of said first positioning ribs can be moved from one of said second positioning spaces to another one of said second positioning spaces so as to change relative angular position of two ends of said spring;

whereby, in a case where said large hollow cylinder is rotated relative to said small hollow cylinder or is moved toward an outer end of said small hollow cylinder, releasing one of said small and large hollow cylinders causes said large hollow cylinder to return to the normal position on said small hollow cylinder.

2. A multi-functional physical exercise apparatus, comprising:

a small hollow cylinder equipped with a cover disposed on an outer end thereof;

a large hollow cylinder sleeved movably no a normal position on said small hollow cylinder, said large hollow cylinder being equipped with a retaining cap disposed on an outer end thereof, each of said cover and said retaining cap including two parallel grooves formed therein, and a U-shaped pulling strip having two ends mounted pivotally in said grooves, and wherein said retaining cap has a circular tubular projection protruding from an inward end surface thereof, said cover including a central rod projecting axially from an inward end surface thereof;

a confining device confining said large hollow cylinder on said small hollow cylinder, and a coiled spring secured to one of said small and large hollow cylinders at one end thereof and confined at a predetermined position in the other one of said small and large hollow cylinders at the other end of said coiled spring, wherein said confining device includes an inward flange projecting from an inner surface of said large hollow cylinder, said small hollow cylinder extending through said inward flange of said large hollow cylinder, an outward flange projecting from an outer surface of said small hollow cylinder and sized so that said outward flange can be put into said large hollow cylinder but cannot pass through said inward flange of said large hollow cylinder, and said retaining cap being connected removably to an end of said small hollow cylinder so as to confine said inward flange of said large hollow cylinder between said outward flange of said small hollow cylinder and said retaining cap; and a compression force adjustment device provided to adjust compression force of said spring, an externally threaded adjustment rod mounted rotatably in said small and large hollow cylinders, a portion of said spring being sleeved on said adjustment rod, said adjustment rod being in the form of a hollow cylinder having an open first end portion in which said central rod of said cover is disposed, and a second end portion journalled in said circular tubular projection of said retaining cap; an internally threaded pressing element engaged threadably with said adjustment rod in said small and large hollow cylinders, the end of said spring being secured to said pressing element, and a rotary knob mounted removably on said retaining cap and connected to said adjustment rod in such a manner that said adjustment rod rotates synchronously with said rotary knob, whereby, when said rotary knob is rotated, said adjustment rod rotates to move said pressing element toward or away from said spring;

whereby, in a case where said large hollow cylinder is rotated relative to said small hollow cylinder or is moved toward an outer end of said small hollow cylinder, releasing one of said small and large hollow cylinders causes said large hollow cylinder to return to the normal position on said small hollow cylinder.

* * * * *